United States Patent [19]

Kiedaisch

[11] Patent Number: 4,815,609

[45] Date of Patent: Mar. 28, 1989

[54] DISPLAY CARTON

[75] Inventor: Randall A. Kiedaisch, Bourbonnais, Ill.

[73] Assignee: Manville Corporation, Denver, Colo.

[21] Appl. No.: 136,057

[22] Filed: Dec. 21, 1987

[51] Int. Cl.[4] ..... B65D 5/54

[52] U.S. Cl. ..... 206/606; 206/611; 206/627

[58] Field of Search ..... 206/606, 611, 623, 627, 631

[56] References Cited

U.S. PATENT DOCUMENTS

| | | | |
|---|---|---|---|
| 3,065,896 | 11/1962 | Grapp | 206/611 |
| 3,131,852 | 5/1964 | Forbes, Jr. | 206/611 |
| 3,372,794 | 3/1968 | Kohlhaas | 206/44 R |
| 3,542,192 | 11/1970 | Steck | 206/627 |
| 3,917,158 | 11/1975 | Dosofachuk et al. | 206/44 R |
| 4,349,110 | 9/1982 | Hayashi | 206/606 |
| 4,421,229 | 12/1983 | Pan et al. | 206/44 R |
| 4,553,666 | 11/1985 | Gullikson | 206/627 |
| 4,621,736 | 11/1986 | Roccaforte | 206/606 |

FOREIGN PATENT DOCUMENTS

| | | | |
|---|---|---|---|
| 814827 | 6/1969 | Canada | 206/611 |
| 896384 | 3/1972 | Canada | 206/606 |

*Primary Examiner*—Stephen Marcus
*Assistant Examiner*—Gary E. Elkins
*Attorney, Agent, or Firm*—John D. Lister

[57] ABSTRACT

A carton for packaging a plurality of articles and adapted to have the top removed in order to function as a display carton. Front and back panel flaps used in forming the front and back panels of the carton contain tear strips, as do the side panels and the dust flaps extending from the side panels. The resulting carton structure contains a tear strip extending completely around the perimeter of the carton to allow the top to be removed.

7 Claims, 2 Drawing Sheets

FIG. 1.
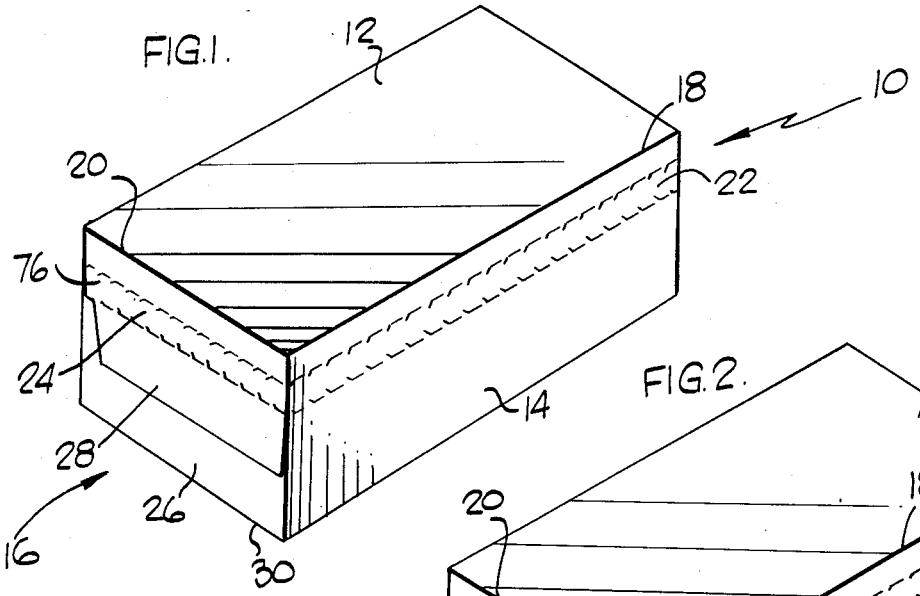
FIG. 2.
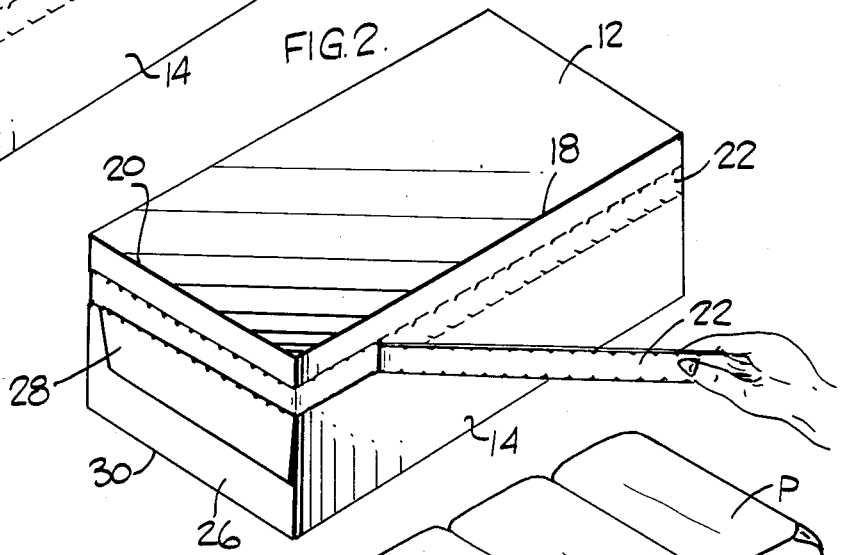
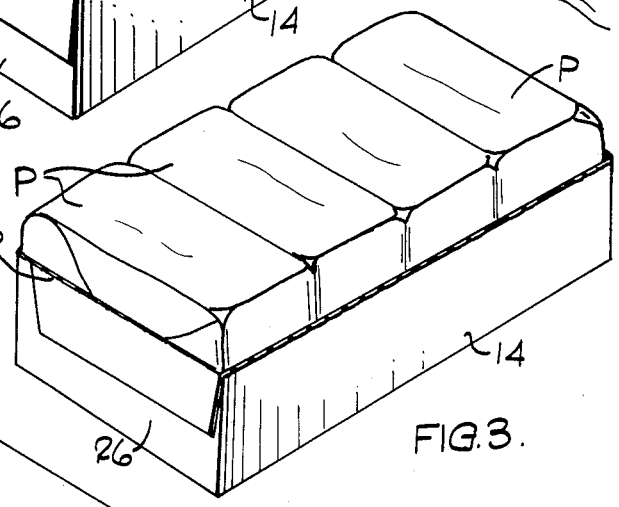
FIG. 3.
FIG. 5
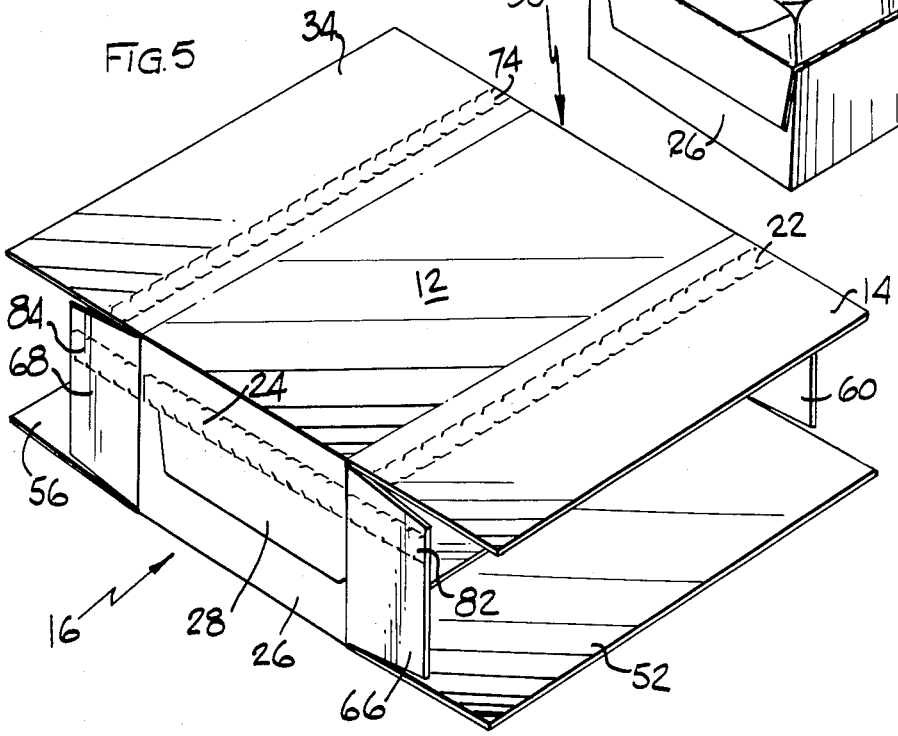

DISPLAY CARTON

FIELD OF THE INVENTION

This invention relates to display cartons. More particularly, it relates to a carton which can be used either as a unitary package or as a display carton.

BACKGROUND OF THE INVENTION

Certain types of products are shipped to retail outlets in cartons containing a number of individual packets or units. If the customer purchases the entire carton the package is sold unopened, but if the retailer wishes to display the individual items the contents of the package would normally have to be removed and transferred to a separate display container. To avoid the extra handling involved and the extra display containers required, it is preferred to use a shipping carton which can also serve as a display carton. In most cases this involves the removal of the top of the carton to expose the contents.

Although it is known to remove relatively small lids from functional cartons by means of tear strips, display cartons, which ideally should have a relatively large cross-sectional area so as to expose a number of individual articles to view, require a design which enables large size panels to be removed. The design should also result in a carton having sufficient strength to carry the articles and to resist the stresses to which the carton is subjected during shipping and handling.

It would therefore be desirable to provide such a carton which can be fabricated efficiently and economically and which presents a neat, clean appearnace after the top has been removed.

BRIEF SUMMARY OF THE INVENTION

This invention comprises a container of generally rectangular configuration wherein one of the side panels comprises two overlapping flaps which are adhered together and which extend from fold lines along the side edges of the top and bottom panels. Each of the overlapping flaps contains a tear strip extending substantially completely across the width of the flap, the tear strips being located so that one of the tear strips overlies the other and so that both tear strips can be removed together. The other side panel and the front and back panels also contain tear strips which extend substantially completely across the width of the panels, the tear strips being aligned so that together they extend substantially around the perimeter of the carton. Dust flaps connected to the side panels also contain tear strips which coincide with the tear strips in the front and back panel flaps to enable the front and back panels to be completely separated along their tear strips.

Other features and aspects of the invention, as well as its various benefits, will be made clear in the more detailed description of the invention which follows.

BRIEF DESCRIPTION OF THE DRAWINGS

FIG. 1 is a pictorial view of a closed carton of the present invention;

FIG. 2 is a pictorial view of the carton of FIG. 1, showing the tear strip in the process of being removed;

FIG. 3 is a pictorial view of the carton of FIG. 1, showing the remaining carton base after the top panel has been removed;

FIG. 5 is a pictorial view of a carton sleeve formed from the blank of FIG. 4;

DESCRIPTION OF THE INVENTION

Figure 4:
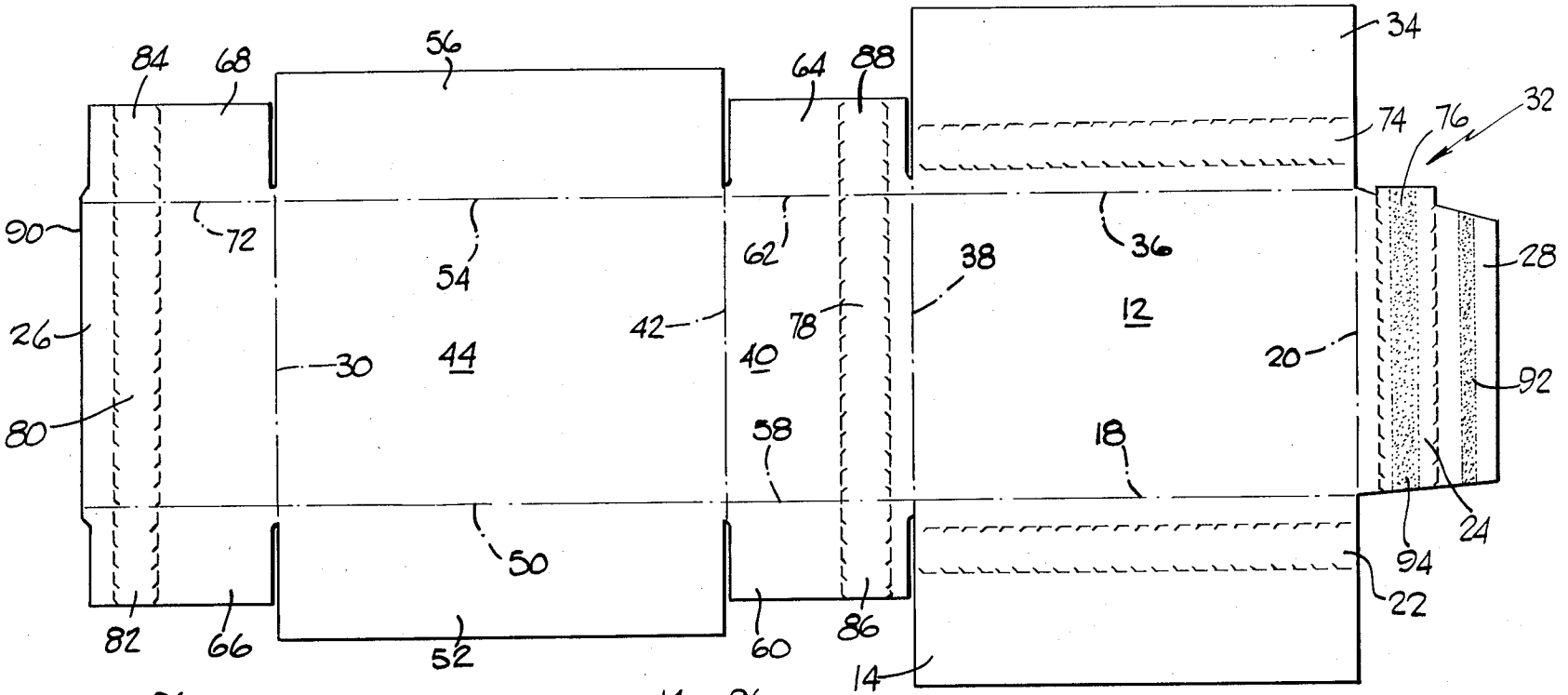
FIG. 4 is a plan view of a production blank for forming the carton of FIG. 1.

Referring to FIG. 1, the carton 10 comprises a top panel 12 connected to front panel 14 and side panel 16 along fold lines 18 and 20, respectively. In addition, the carton includes another side panel, a back panel and a bottom panel, none of which are visible in this view, to complete the closed carton. The front panel 14 contains a tear strip 22 extending substantially the full width of the front panel and the side panel 16 contains a tear strip 24 extending substantially the full width of the side panel. The tear strips are located a short distance below the top panel 12 and are aligned so that they form a continuous tear strip in the panels 14 and 16. It should be understood that the other side panel and the back panel also contain similar tear strips so that all the separate tear strips form a continuous tear strip around the entire perimeter of the carton.

Still referring to FIG. 1, it can be seen that the side panel 16 is formed from separate side panel flaps 26 and 28. The inner side panel flap 26 is connected to the bottom panel along fold line 30 while the outer side panel flap 28 is connected to the top panel along fold line 20. The flaps 26 and 28 are adhered together by glue to form the side panel 16.

The tear strip 24 is connected to the tear strip 22 by structure not yet described and is adapted to be grasped at the end adjacent the back panel of the carton so that when pulled, as shown in FIG. 2, the tear strip 24 is first removed, followed by the tear strip 22. When the connected tear strips are removed from around the perimeter of the carton the top 12 can be removed and the remaining carton base, shown in FIG. 3, can serve as a display carton. The contents of the carton, such as packets P, are thus presented to view.

The inner surface of a production blank 32 used to form the carton 10 is illustrated in FIG. 4, wherein the blank can be seen to comprise a top panel section 12 connected at one of its side edges along score line 20 to outer side panel flap 24. An outer front panel flap 14 is connected to the front edge of the top panel section 12 by score line 18 and an outer back panel flap 34 is connected to the back edge of the top panel section 12 by score line 36. Connected to the other side edge of the top panel section along score line 38 is side panel section 40, which corresponds to the side panel not visible in FIGS. 1–3.

The side panel section 40 is connected at its opposite side edge along score line 42 to bottom panel section 44. The other side edge of the bottom panel section 44 is connected along score line 30 to inner side panel flap 26. Connected to the front edge of the bottom panel section 44 along score line 50 is inner front panel flap 52, and connected to the back edge of the bottom panel section along score line 54 is inner back panel flap 56.

Connected to the front edge of side panel section 40 along score line 58 is dust flap 60, and connected to the back edge of side panel section 40 along score line 62 is dust flap 64. Dust flaps 66 and 68 are similarly connected to the front and back edges of inner side flap 26 along score lines 70 and 72, respectively.

As shown in FIG. 4, the outer front panel flap 14 contains a tear strip 22 extending from one side edge of the flap to the other, corresponding to the tear strip 22 shown in the carton 10 in FIGS. 1–3. The outer back panel flap 34 similarly has a tear strip 74 extending from one side edge of the flap to the other. In like manner, the outer side panel flap 28 has a tear strip 24 extending the full width of the flap. One end of the tear strip 24 is shown at 76 as extending slightly beyond the edge of the flap 28 in order to provide an end for the user to grasp to initiate the tearing action.

The side panel section 40 is also provided with a tear strip 78 extending from the score line 58 to the score line 62, and the inner side panel flap 26 is provided with a tear strip 80 extending from the score line 70 to the score line 72. In addition, all the dust flaps have tear strips which in effect are extensions of the tear strips in the adjacent side panel section. Thus tear strips 82 and 84 are provided in dust flaps 66 and 68, respectively, extending from the ends of tear strip 80 to the ends of the dust flaps. Similarly, tear strips 86 and 88 are provided in dust flaps 60 and 64, respectively, extending from the ends of tear strip 78 to the ends of the dust flaps. Preferably, the score line 72 is interrupted by a slit at the end of tear strips 80 and 84 to facilitate the initial tearing action that takes place when end 76 of the adhered tear strip 24 is grasped and pulled. All of the tear strips in side panel section 40 and in flaps 14, 28 and 34 are located the same distance from the score lines which form the edges of the top panel section 12 so as to provide a substantially continuous tear strip around the perimeter of a carton formed from the blank. In the case of the tear strip 80 in inner side panel flap 26, it is located a similar distance from the edge 90, which in its folded condition in the carton is at substantially the same level in the carton as the score lines 18, 20, 36 and 38.

The stippled areas 92 and 94 on the inside surface of the outer side panel flap 28 represent areas on which glue is applied prior to folding the blank for shipment to the packager. After the glue has been applied the inner side panel flap 26 is folded up about score line 30 until it is in face-to-face relationship with the bottom panel section 44, and the top panel section 12 is folded up about score line 38 until it is in face-to-face relationship with the side panel section 40 and a portion of the bottom panel section 44. After these folds have been made the score line 20 will be substantially in alignment with the edge 90 of the inner side panel flap 26, and the inside surface of the outer side panel flap 28 will overlie the outside surface of the inner side panel flap 26. The glue in the stippled area 94 on the tear strip 24 will thus contact the tear strip 80, adhering the tear strips together. The glue in the stippled area 92 near the free edge of the outer side panel flap 28 will contact the inner side panel flap 26 at a location between the tear strip 80 and the score line 30. This arrangement produces a flattened sleeve which after being received by the packager can be opened up to form the open ended sleeve 95 shown in FIG. 5.

Referring to FIG. 5, it can be seen that due to the gluing of the outer side panel flap 28 to the inner side panel flap 26, when the sleeve is opened the outer side panel flap 28 folds down about score line 20 to cause the folded blank to assume the sleeve form shown. The dust flaps 60 and 66 extend outwardly from their associated side panels in unfolded condition, and the inner and outer front panel flaps 52 and 14 likewise extend outwardly from the bottom and top panels, respectively, in unfolded condition. A similar arrangement exists at the opposite open end of the carton sleeve. The dust flaps also extend outwardly in unfolded condition and the tear strips therein form a continuation of the tear strip in the associated side panel. Thus the tear strips 82 and 84 in dust flaps 66 and 68, respectively, are aligned with and extend from the ends of the combined overlying tear strips 24 and 80 in the side panel formed from the side panel flaps 26 and 28.

Figure 6:
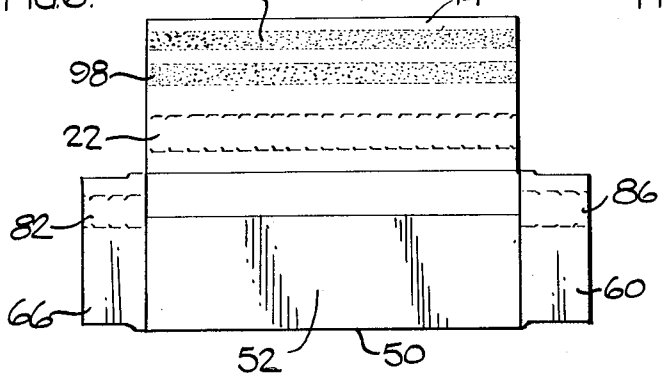
FIG. 6 is a front view of the sleeve of FIG. 5 after the inner front panel flap has been folded up.

Referring to FIG. 6, the open-ended carton sleeve of FIG. 5 is shown after the inner front panel flap 52 has been folded up about its score line 50, which is the first step in forming the front panel of the carton after the folded blank has been opened to the sleeve form of FIG. 5. The outer front panel flap 14 is shown as having been folded slightly up about its score line 18 in order to better illustrate the stippled areas 96 and 98 on the inside face of the flap 14 on which glue is applied. It should be understood that this glue application is not made by the carton manufacturer but by the packager after receiving the flattened sleeve from the manufacturer. Therefore the areas 96 and 98 of glue application have not been shown on the blank of FIG. 4.

Figure 7:
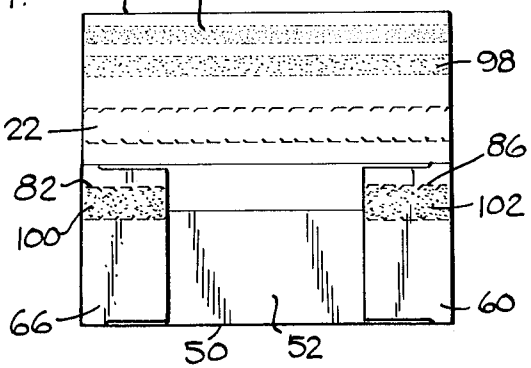
FIG. 7 is a view similar to that of FIG. 6, but showing the sleeve after the dust flaps have been folded over.

Referring to FIG. 7, the next step in forming the front panel of the carton is to fold in the dust flaps 60 and 66 to overlie the inner front panel flap 52. The tear strips 82 and 86 in the dust flaps are aligned with each other and are substantially parallel to the top and bottom panels. The upper edge of the inner front panel flap 52 is generally aligned with the bottom edge of the tear strips 82 and 86 so that when the tear strips are removed the panel structure remaining presents a neat even appearance, as in the display carton shown in FIG. 3. The outer faces of the tear strips 82 and 86 also receive an application of glue in the stippled areas 100 and 102, respectively.

Figure 8:
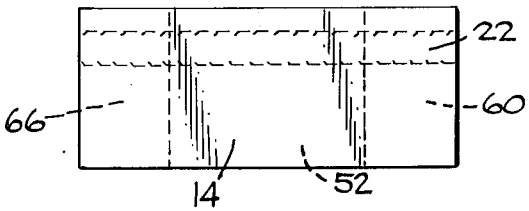
FIG. 8 is a view similar to that of FIG. 7, but showing the front panel of the carton in place after folding the outer front panel flap down.

The final step in forming the front panel of the carton consists of folding down the outer front panel flap 14 to the position shown in FIG. 8. The dust flaps 60 and 66 and the inner front panel flap 52 are shown in dotted lines in this view in order to illustrate the relative positions of all the flaps which make up the front panel of the carton. The flap 14 preferably extends from its fold line at the front edge of the top panel down to the bottom panel to substantially entirely cover the inner front panel flap 52. This arrangement provides at least a double wall thickness throughout the front and back panels to make a sturdy carton and present a clean pleasing appearance.

It can be seen in FIGS. 7 and 8 that the glue in areas 96 and 98 adheres the flap 14 to both the dust flaps 60 and 66 and to the inner front panel flap 52. If the dust flaps were folded in before the inner front panel flap 52 is folded up, it would be necessary to glue the inside face of the flap 52 to the outer faces of the dust flaps 60 and 66 in addition to gluing the flap 14 to the flap 52 and the dust flaps 60 and 66. This would entail an extra gluing step in order to adhere together all the flaps forming the front panel of the carton, and would use more glue than is required by the preferred arrangement described above.

The glued areas 100 and 102 on the outer faces of the tear strips 82 and 86 contact the inner face of the tear strip 22 to adhere the tear strips together so that when the main tear strip 22 is pulled away from its flap 14, the dust flap tear strips are pulled away with it by virtue of their adherence to the tear strip 22. The back panel would of course be formed in a manner similar to the front panel.

It can now be seen that by grasping the end 76 of the tear strip 24 in the side panel of the carton and pulling it so as to detach it and the adhered tear strip 80 from the carton, all the connected tear strips will be removed, resulting in the display carton shown in FIG. 3. Thus the problem of removing the top of a carton whose top panel covers a relatively large expanse has been solved in an effective, efficient manner which requires only a minimum of labor and materials to form the folded blank and the final carton. Although the weakened tear strip edges have been shown as being comprised of the well known arrangement of cross cuts separated by small segments of paperboard, they can be formed in other ways as well. For example, the outer edges of the tear strips can be formed by continuous slits which extend only half way through the paperboard. In such an arrangement additional slits intermediate the tear strips would extend half way through the paperboard from the other side of the strip. When the strip is pulled the fibers in the areas of reduced thickness tear and the strip can be removed.

It should be obvious that although a preferred embodiment of the invention has been disclosed, changes to certain of the details of the embodiment may be made without departing from the spirit and scope of the invention as defined in the claims.

What is claimed is:

1. A package adapted for use as a display carton, comprising:

a generally rectangular top panel having front, back and side edges;

a generally rectangular bottom panel having front, back and side edges;

a first side panel connected to one of the side edges of each of the top and bottom panels along fold lines;

a second side panel comprising two overlapping flaps adhered together, one of the flaps being connected to the other side edge of the top panel along a fold line and the other flap being connected to the other side edge of the bottom panel along a fold line;

a front panel connected to the front edges of the top and bottom panels, the front panel comprising two overlapping flaps adhered together, one of the flaps being connected to the front edge of the top panel along a fold line and the other flap being connected to the front edge of the bottom panel along a fold line;

a back panel connected to the back edges of the top and bottom panels, the back panel comprising two overlapping flaps adhered together, one of the flaps being connected to the back edge of the top panel along a fold line and the other flap being connected to the back edge of the bottom panel along a fold line;

each of the front, back and side panels containing tear strip means extending substantially completely across the width thereof, the tear strip means in each of said panels being connected to the tear strip means in adjacent panels, so that removal of the tear strip means in each of the front, back and side panels will enable the portion of the package above the tear strip means to be separated from the portion of the package below the tear strip means;

the tear strip means in the second side panel comprising a tear strip located in each of the overlapping flaps so that one of the tear strips overlies the other; and means permitting the overlying tear strips to be removed together.

2. A package adapted for use as a display carton according to claim 1, wherein the tear strip means in the front and back panels comprise a tear strip in each of the outer overlapping flaps thereof.

3. A package adapted for use as a display carton according to claim 2, wherein each of the first and second side panels comprises front and back edges, the front and back panels further comprising dust flaps connected to the front and back edges of the first and second side panels along fold lines and extending toward each other, each of the dust flaps containing a tear strip underlying the tear strip in the associated outer overlapping flap.

4. A package adapted for use as a display carton according to claim 3, wherein the tear strips in the dust flaps are adhered to the tear strips in the overlapping flaps of the front and back panels.

5. A package adapted for use as a display carton according to claim 4, wherein the dust flaps are located between the inner and outer overlapping flaps of the front and back panels.

6. A production blank for forming a package adapted for use as a display carton, comprising:

generally rectangular top and bottom panel sections having side edges, front edges and back edges;

a side panel section positioned between opposed edges of the top and bottom panel sections and connected thereto by score lines;

side panel flaps connected by score lines to the side edges of the top and bottom panel sections opposite the opposed edges and adapted to overlap each other to form a side panel of a carton formed from the blank;

a front panel flap connected by a score line to the front edge of the top panel section and a front panel flap connected by a score line to the front edge of the bottom panel section, the front panel flaps being adapted to overlap each other to form the front panel of a carton formed from the blank;

a back panel flap connected by a score line to the back edge of the top panel section and a back panel flap connected by a score line to the back edge of the bottom panel section, the back panel flaps being adapted to overlap each other to form the back panel of a carton formed from the blank; and tear strips extending substantially across the width of one of the front panel flaps, one of the back panel flaps, the side panel section and the two side panel flaps, the tear strips in the two side panel flaps being adapted to overlie each other in a carton formed from the blank and the tear strips further being adapted to form a substantially continuous tear strip around the front, back and side panels of a carton formed from the blank so that the portions of the carton separated by the tear strip can be physically separated from each other.

7. A production blank according to claim 6, further including dust flaps connected by score lines to the side panel section and to one of the side panel flaps, the dust flaps containing tear strips extending from the score lines connecting the dust flaps to the side panel section and side panel flap to form a continuation of the tear strips in the side panel section and the side panel flap, whereby when the dust flaps adjacent the front panel flaps of the blank and the dust flaps adjacent the back panel flaps of the blank are folded inwardly toward each other during the formation of a carton, the tear strips in the dust flaps will underlie the tear strips in the front and back panel flaps so as to be removed at the same time as the tear strips in the front and back panel flaps.

* * * * *